United States Patent [19]

Karbstein

[11] Patent Number: 4,560,302

[45] Date of Patent: Dec. 24, 1985

[54] DRAINING DITCH FOR DRAINING OF ROADWAYS

[75] Inventor: Peter Karbstein, Dätgen, Fed. Rep. of Germany

[73] Assignee: ACO Severin Ahlmann GmbH & Co. KG, Rendsburg, Fed. Rep. of Germany

[21] Appl. No.: 681,063

[22] Filed: Dec. 12, 1984

Related U.S. Application Data

[63] Continuation of Ser. No. 491,842, Mar. 5, 1983, abandoned.

[30] Foreign Application Priority Data

May 6, 1982 [DE] Fed. Rep. of Germany ..... 3217001

[51] Int. Cl.[4] ..... E01C 11/22; E01F 5/00

[52] U.S. Cl. ..... 404/4; 404/2; 405/43

[58] Field of Search ..... 404/2–5; 52/606; 405/124, 126, 43

[56] References Cited

U.S. PATENT DOCUMENTS

| | | | |
|---|---|---|---|
| 836,903 | 11/1906 | Sturman | 404/2 |
| 1,224,448 | 5/1917 | Davidson | 404/4 |
| 2,386,020 | 10/1945 | Wendelken | 405/43 |
| 2,436,593 | 2/1948 | Moselowitz | 404/4 |
| 2,701,027 | 2/1955 | Scoville | 404/4 |
| 3,225,545 | 12/1965 | Flegel | 404/2 |
| 3,797,188 | 3/1974 | Mansfeld | 404/2 |
| 3,876,322 | 4/1975 | Deason | 404/2 |
| 4,322,179 | 3/1982 | Lamphier et al. | 404/4 |

FOREIGN PATENT DOCUMENTS

| | | | |
|---|---|---|---|
| 0025808 | 4/1981 | European Pat. Off. | 404/2 |
| 1071497 | 6/1967 | United Kingdom | 404/4 |
| 1344236 | 1/1974 | United Kingdom | 404/2 |

*Primary Examiner*—Stephen J. Novosad
*Assistant Examiner*—Bruce M. Kisliuk
*Attorney, Agent, or Firm*—Beveridge, DeGrandi & Weilacher

[57] ABSTRACT

The invention relates to a draining ditch for the draining of roadways comprising a ditch body of U-shaped cross-sectional area which is potted in the concrete bed of the roadway and a cover plate or body covering the upper surface of the ditch body, the plate being provided with an abrasion resistance equal to or less than that of the roadway and having a thickness of at least half of the width of the ditch body and with a plurality of inlet openings.

17 Claims, 5 Drawing Figures

DRAINING DITCH FOR DRAINING OF ROADWAYS

This application is a continuation, of application Ser. No. 491,842, filed Mar. 5, 1983, now abandoned.

The invention relates to a draining ditch for the transverse draining of roadways, comprising a ditch body of U-shaped cross-sectional area which is potted in the concrete bed of the roadway and a cover plate or body covering the upper surface of the ditch body, said plate being provided with a plurality of inlet openings.

A draining ditch of this type has become known for instance from the German disclosure letter No. 27 03 583. The ditch body preferably consists of polyester concrete, and the cover plate formed of metal is undetachably rigidly connected to the upper surface of the ditch body with the aid of anchoring pins and/or an adhesive mass.

It has furthermore become known for roadways subjected to considerable traffic to provide ditch bodies having the upper surface thereof connected to a metallic frame with a cover plate or a covering grid formed of steel or cast iron loosely placed thereon and therein, respectively. The frame is fixed in the concrete bed by means of anchors, while the covering grid is anchored at the ditch body with the aid of a suitable fastening means. Such a measure is necessary, because otherwise the transverse forces caused by the vehicles would be able to lift off and swing about the covering grid. The latter may be connected with considerable danger to the lives of human beings.

It has been found that with roadways travelled with a high frequency of vehicles and high speeds the cover plates are subjected to extremely high dynamic forces which the anchoring means between the cover plate and the ditch body are not always able to withstand. The danger is at least imminent that the cover plate construction may break and thereby massive foreign bodies may get on to the roadway bringing on with them considerable danger.

Because of the substantial load, in connection with the known draining ditches, the cover plates are always formed of steel or cast iron. It has been found, however, that in the course of time the roadway is relatively quickly worn off by some millimeters. This sinking a cover plate of metal is unable to follow.

The result of this sinking of the roadway is that the water inlet zone lies at a higher level than the roadway plane, so that a water pool may even form bringing about the danger of aquaplaning. Besides, the projecting metal construction forms an obstruction in the roadway. When crossed at high speed it will cause hard knocks against the vehicles which have an adverse effect on the vehicle and are disagreeable for the driver.

It is the object of the invention to provide a draining ditch for transverse draining of roadways, which does not suffer from the above mentioned drawbacks and is in particular able to withstand the loads even in case of a considerable vehicle frequency, with the water inlet zone thereof even during extended periods of use being always disposed in the plane of the roadway plane and slightly therebelow, respectively.

This object is obtained according to the invention in that the cover plate consists of a material, the abrasion resistance of which is equal too or smaller than that of the roadway surface, and which is form-closedly potted with the concrete bed and the material of the roadway surface, respectively.

The invention starts out from the knowledge that the level of a roadway does not constitute a constant quantity but due to abrasion steadily sinks. The point therefore is that the water inlet zone follows such sinking, so that a position of the water inlet zone elevated thereover is avoided. The formation of the cover plate from a material having an abrasion resistance equal to or smaller than that of the roadway surface takes care that the cover plate will be abraded in common with the roadway surface and, therefore, will sink together with it. The water inlet zone, therefore, can at no time rise above the level of the roadway plane. Thereby, unevennesses in the roadway as described in connection with metallic cover plates, are also avoided.

Owing to the fact that the cover plate is potted in the material of the roadway surface and the concrete bed, respectively, a form-closed embedding of the cover plate is the result. Therefore, it cannot be torn out even with maximum dynamic loads effective thereon over an unlimited space of time.

The cover plate or body according to the invention may be used together with conventional ditch bodies of U-shaped cross-section. The latter are usually made of polyester concrete. According to one embodiment of the invention also the cover plate consists of polyester concrete.

Provision is made in another embodiment of the invention for the ditch body and the cover plate to be adhesively connected with each other prior to being placed. The adhesive connection does not play any part for the operation of the draining ditch according to the invention. It therefore does not serve the purpose of an additional anchoring of the cover plate at the ditch body. It is, however, to be preferred especially in case of sensitive adhesives being used at the production site for reasons of manufacturing technique. Besides, ditch body and cover plate may be placed in common, which brings about a saving in mounting costs at the construction site.

It goes without saying that the cover plate must be supported in a suitable manner at the ditch body. In this connection provision is made in another embodiment of the invention for the underside of the cover plate to have grooves extending in parallel formed therein, with the walls of the ditch body form-closedly engaging within said grooves. In an alternative embodiment of the invention it is proposed in this connection that continuous shoulders be formed on the underside of the cover at the corner edges thereof, said shoulders cooperating with the upper surface of the walls of the ditch body. The outer surfaces of the ditch body therefore preferably end flush with the outer surface of the cover plate.

Advantageously, both grooves and lateral shoulders are formed in. Thereby, one single cover plate may be used for two different inner diameters of a ditch body.

As already mentioned, it is desired that abrasion of the cover plate occurs during operation. In this connection it must be ensured that even after a predetermined abrasion the cover plate will still have a sufficient strength, in order to withstand the occurring loads. Therefore, provision is made in another embodiment of the invention for the height or thickness of the cover plate to be at least half the inner diameter of the ditch body. In a preferred embodiment, the thickness of the cover plate is approximately equal to the inside diameter of the ditch body. The relatively great thickness of the cover plate in addition has the advantage that the ditch body may be placed relatively deep and thereby may discharge the water relatively safe from frost. Cloggings of the draining ditch by ice are therefore largely avoided.

According to another embodiment of the invention provision is made for the cover plate to consist of a lower portion extending the entire width of the ditch body and an upper narrower portion. In addition to the material saving resulting from this configuration, a particularly high strength is also obtained above all in the vertical direction.

To increase the transverse strength provision is made in another embodiment of the invention for ribs to be integrally formed at the outer surfaces of the lower and upper portions interconnecting them.

In the following, an example of embodiment of the invention will be described in more detail by way of drawings.

Figure 1:
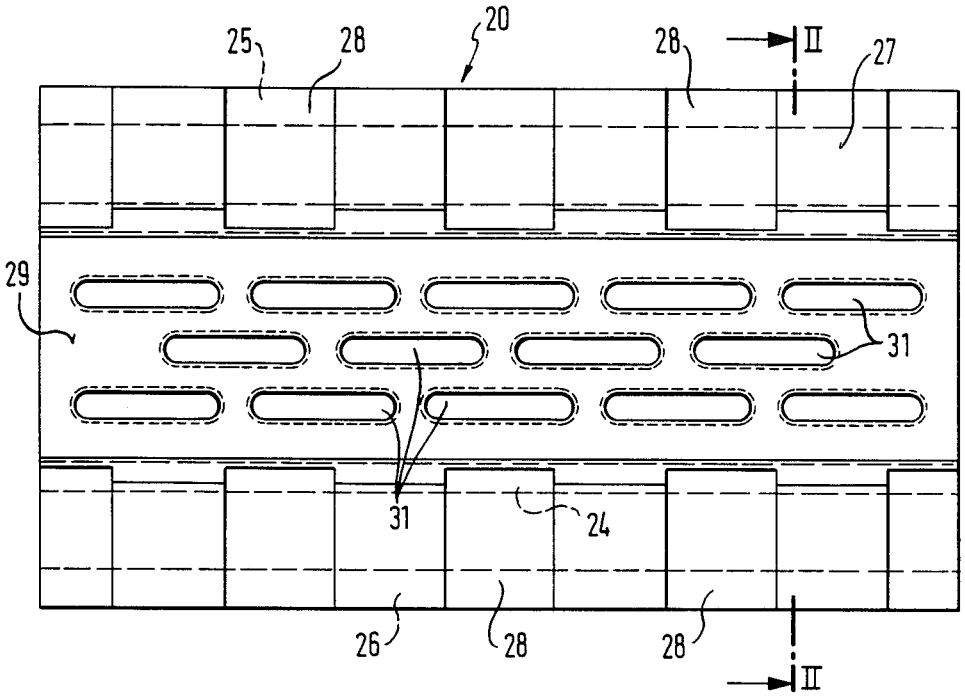
FIG. 1 shows a plan view taken on a draining ditch according to the invention.

Prior to enlarging in more detail on the individual representations shown in the drawings, let it be stated that each of the features shown and described is of inventively essential importance either by itself or in connection with features of the claims.

Figure 2:
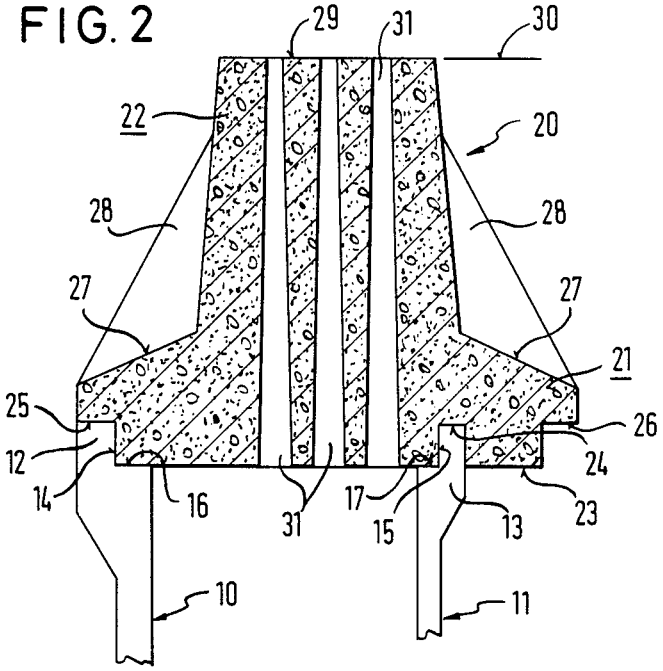
FIG. 2 shows a sectional view taken along line II—II of the representation according to FIG. 1.

In FIG. 2, two different ditch bodies are each indicated by a sidewall 10 and 11, respectively. They are of similar cross-sectional shape, however, have different inside diameters. The ditch body 10 has an inside diameter of 200 and the ditch body 11 has an inside diameter of 100 mm. The ditch bodies are formed in usual manner of polyester concrete. At the upper surface thereof they have an elevated edge region 12, 13 of rectangular cross section forming an elongated recess 14 and 15, respectively, at the inner surface of the sidewalls 10 and 11, respectively, with a shoulder 16 and 17, respectively.

The cover plate for the exemplary ditch bodies is generally referenced 20. It has a lower portion 21 and an upper portion 22. The lower portion has a smooth lower surface 23 with two grooves formed therein to extend in parallel at the underside thereof, one of said grooves being shown at 24. Formed in the corner edges of the lower portion 21 are longitudinally extending recesses 25 and 26, respectively, which are rectangular in cross-section. As may be seen from FIG. 2, the elevated portions 12 and 13, respectively, are engaging within the grooves 24 and the lateral recesses 25 and 26, respectively, with the lower surface 23 seated on the shoulders 16 and 17, respectively. The outside surfaces of the lower portion 21 in this arrangement end flush with the outer surface of the walls 10 of the ditch body.

From FIG. 2 it may be recognized that through a minor modification of the cover plate 20 ditch bodies of different inside diameters may be covered.

The lower portion 21 of the cover plate 20 is shaped in the manner of a roof at the upper surface thereof, as shown at 27, and merges with the upper portion 22, which steadily reduces slightly in its width in an upward direction. The height of the upper portion 22 is approximately double the height of the lower portion 21, and the overall height of the cover plate 20 ranges with the inside diameter of the ditch body equipped with the wall 10. The outer surfaces of the lower and upper portions have ribs 28 integrally formed thereat in longitudinally spaced arrangement, which increase the lateral stability of the cover plate 20.

The upper surface 29 of the upper portion 22 forms the water inlet zone. With the ditch body fitted together with the cover plate 20 it is disposed level with the roadway plane, as indicated by the arrow 30. Besides, the ditch body is potted in the concrete bed and the material of the roadway surface, respectively, together with the cover plate, so that a safe anchoring of the cover plate is guaranteed.

Owing to the fact that the cover plate 20 likewise consists of abradable material, especially polyester concrete, the upper portion 22 is abraded together with the roadway, so that it is secured that the water inlet zone 29 will always be level with the roadway plane 30 or will be disposed therebelow.

As may be recognized from FIGS. 1 and 2, three rows of water inlet slots 31 respectively arranged one after the other are formed to extend in a longitudinal direction, which are slightly enlarging downward in a manner known per se. The inlet slots 31 are respectively offset with respect to adjacent ones by half a length, in order to retain a sufficient stability of the cover plate.

The ditch body and cover plate 20 are rigidly connected with each other upon completion of the manufacture thereof by means of a suitable adhesive mass, so that they can be handled and fitted on site as a unit.

Figure 3:
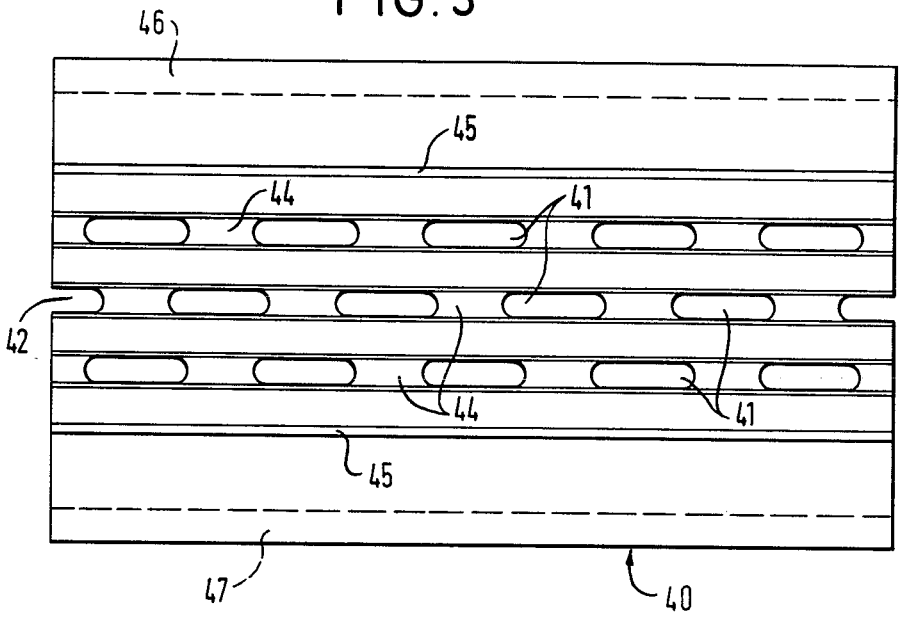
FIG. 3 shows a plan view taken on a modified cover plate of a draining ditch according to the invention.
Figure 4:
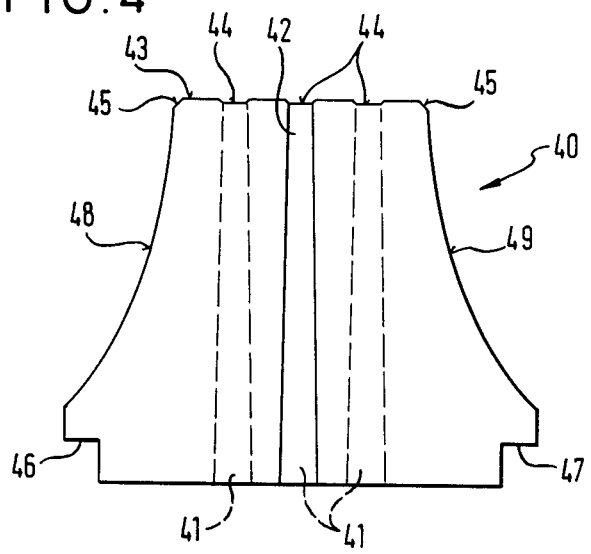
FIG. 4 shows an end view of the cover according to FIG. 3.

The cover plate 40 according to FIGS. 3 and 4 is built up in a similar manner as the one according to FIGS. 1 and 2. It has three parallel rows of water inlet openings 41 which, as indicated in FIG. 4 by broken lines, likewise slightly taper upward from below. The water inlet openings 41 are arranged respectively to abut the spaces between the openings of the adjacent row. The arrangement of the water inlet openings 41 is such that the inlet openings in the center row are opening towards the end face as indicated at about 42. The upper surface 43 of the cover plate 40, which again levels in height with the roadway level, is provided with three parallel grooves 44 having the upper ends of the inlet openings 41 terminating therein, as may be clearly recognized in FIGS. 3 and 4. The upper corner edges of the cover plate 40 are tapered as shown at 45.

The cover plate 40 is provided in the lower region thereof with a continuous recess 46 and 47, respectively, or a groove, in order to co-operate in a similar manner with a draining ditch (not shown) as indicated in the lefthand half of FIG. 2.

The cover plate shown according to FIGS. 3 and 4 has a constant cross-section longitudinally, with the outer surfaces 48, 49 being concavely curved. Besides, the same advantages are valid with respect to the embodiment according to FIGS. 3 and 4 as have been explained in connection with the embodiment according to FIGS. 1 and 2.

Figure 5:
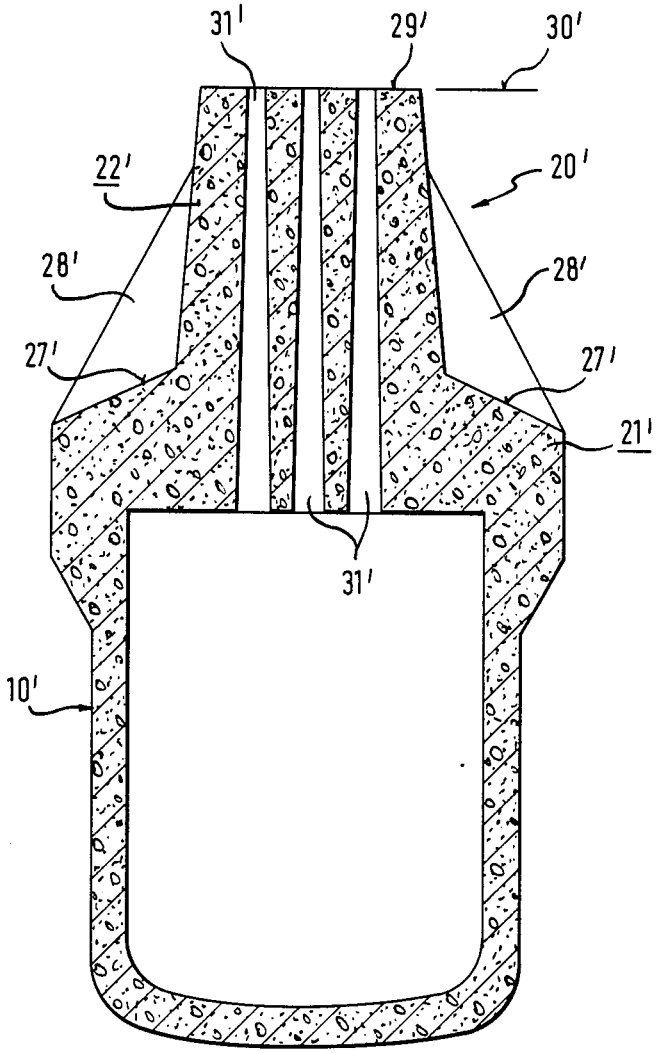
FIG. 5 shows a sectional view taken on a draining ditch formed in one piece.

The embodiment according to FIG. 5 shows a ditch body with a cover plate formed in one piece, with the configuration corresponding to the embodiment according to FIG. 2, lefthand side. Therefore, reference numerals in correspondence with the embodiment according to FIG. 2, but primed, have been selected.

In the embodiment according to FIG. 5 the cover plate 20' and the draining ditch 10' are formed in one piece of a suitable polymer concrete. Besides, the same advantages are valid as have been indicated in connection with the embodiment according to FIGS. 1 and 2.

I claim:

1. A draining ditch for draining of a roadway, comprising a ditch body portion which is U-shaped in cross-section and is adapted for being embedded in said roadway and a cover body portion covering the upper surface of the ditch body portion, said cover body portion having a plurality of water inlet openings, said cover body portion having an abrasion resistance equal to or less than that of the roadway surface and said cover body portion having a thickness which is at least half of the width of said ditch body portion said cover body portion being adapted to be embedded into the said roadway.

2. A draining ditch according to claim 1, further comprising the ditch body and the cover body (20) are formed of polyester concrete.

3. A draining ditch according to claim 1, further comprising the ditch body and the cover body (20) are adhesively connected to each other prior to being placed.

4. A draining ditch according to claim 1, further comprising parallel grooves (24) are formed on the underside of the cover body and the walls (11) of the ditch body being adapted to engage therewith.

5. A draining ditch according to claim 1, further comprising continuous shoulders (24, 25) are formed at the corner edges on the underside of the cover body (21), which are adapted to be in cooperative engagement with the upper surface of the walls (10, 11) of the ditch body.

6. A draining ditch according to claim 5, further comprising the underside of the cover body (20) inward of the shoulders co-operates with a shoulder of the ditch body walls (10, 11) disposed in downward offset arrangement.

7. A draining ditch according to claim 1, further comprising the thickness of the cover body (20) is approximately equal to the inner diameter of the ditch body.

8. A draining ditch according to claim 1, further comprising the cover body consists of a lower portion (21) spanning the width of the ditch body and a narrower upper portion (22).

9. A draining according to claim 8, further comprising the cross-section of either the lower or the upper portion (21 and 22, resp.) or both portions (21 and 22, resp.) steadily decreases in the upwardly direction.

10. A draining ditch according to claim 8, further comprising the lower and upper portions having ribs (28) interconnecting them and formed integrally on the outer surfaces thereof.

11. A draining ditch according to claim 1, further comprising the inlet openings are formed as slots extending longitudinally of the cover body (20).

12. A draining ditch according to claim 1 further comprising the ditch body portion (10') and the cover portion (20') are formed in one piece.

13. A draining ditch according to claim 12, further comprising wherein the ditch body portion and the cover body portion are formed of polyester concrete.

14. The drainage ditch according to claim 12, further comprising the thickness of the cover body portion being at least equal to half the inner diameter of the ditch body portion.

15. The drainage ditch according to claim 12, further comprising wherein the thickness of the cover body portion is approximately equal to the inner diameter of the ditch body portion.

16. The draining ditch according to claim 12, further comprising wherein the cross-section of the cover body portion gradually decreases in the upwardly direction.

17. The draining ditch according to claim 12, further comprising wherein the upper portion of the cover body portion has ribs integrally formed on the outer surface of said body portion.

* * * * *